US005526958A

United States Patent [19]

Küppersbusch

[11] Patent Number: 5,526,958

[45] Date of Patent: Jun. 18, 1996

[54] TUBE BOX

[76] Inventor: Gerd Küppersbusch, Postfach 10 05 05, D-5620 Velbert 1, Germany

[21] Appl. No.: 261,749

[22] Filed: Jun. 17, 1994

Related U.S. Application Data

[63] Continuation of Ser. No. 980,788, filed as PCT/EP92/01301, Jun. 9, 1992, abandoned.

[30] Foreign Application Priority Data

Jun. 17, 1991 [DE] Germany ..... 41 19 922.7

[51] Int. Cl.[6] ..... B65D 35/28; B65D 35/56

[52] U.S. Cl. ..... 222/105; 222/103; 229/101

[58] Field of Search ..... 222/103, 105, 222/107, 183; 229/101, 108, 108.1, 119, 125.15

[56] References Cited

U.S. PATENT DOCUMENTS

| | | | |
|---|---|---|---|
| 2,180,841 | 11/1939 | Vogt . | |
| 2,393,103 | 1/1946 | Groedel | 222/105 X |
| 2,454,919 | 11/1948 | Hagan | 222/105 X |
| 3,469,743 | 9/1969 | Becker | 222/105 |
| 4,418,861 | 12/1983 | McFarland et al. | 229/108.1 |
| 4,520,948 | 6/1985 | Hampel et al. | 222/103 |
| 4,674,655 | 6/1987 | Löfgrer | 222/103 X |
| 4,722,462 | 2/1988 | Zinnbauer | 229/101 X |
| 5,156,295 | 10/1992 | Gordon et al. | 222/105 X |

FOREIGN PATENT DOCUMENTS

| | | | |
|---|---|---|---|
| 0172711 | 2/1986 | European Pat. Off. . | |
| 0225677 | 6/1987 | European Pat. Off. . | |
| 768033 | 7/1934 | France | 222/105 |
| 6945691 | 4/1970 | Germany . | |
| 9006167 | 11/1990 | Germany . | |
| 648259 | 10/1962 | Italy | 222/105 |
| 366792 | 2/1963 | Switzerland . | |

*Primary Examiner*—Kevin P. Shaver
*Attorney, Agent, or Firm*—George W. Neuner

[57] ABSTRACT

A outer cardboard box is provided for an inner bag, the box having a spout so that viscous, creamy or pasty material can be dispensed from the spout. In this box, the bottom wall opposite to the pouring spout is connected with only two sidewalls so that when the sidewalls are compressed to cause a flow of material from the inner bag and through the spout, the bottom wall bulges inwardly and the other sidewalls bulge outwardly.

9 Claims, 2 Drawing Sheets

TUBE BOX

This is a continuation of Ser. No. 07/980,788 filed as PCT/EP92/01301, Jun. 9, 1992, now abandoned.

The invention relates to a tube box.

Such boxes are well suited for transporting and pouring-out bulk material such as powder material on the one hand and liquids the other hand. However, if the on material to be stored in the box has a high viscosity or is even creamy or pasty, the above described box exhibits the problem that the material cannot easily be emptied from the box.

It it therefore the object underlying the invention to improve the tube box of the initially described kind such that the withdrawal of creamy or pasty materials from the package is enabled.

This object is achieved by a tube box of the initially described kind which is characterized by the features described in the detailed description.

Since the bottom wall is connected to only two sidewalls, while at least one sidewall has no connection with the bottom wall, the two sidewalls which are connected with the bottom wall can be compressed. The sidewall which is not connected to the bottom wall can yield outwardly. Hence, the entire box can be compressed. Therefore, even creamy or pasty material can be pressed out of the box.

If the bottom wall is slightly overdimensioned between the sidewalls connected thereto, the bottom wall is forced to bulge either into or out of the box. This further facilitates the compression of the box. In particular in case that it bulges into the box, the inner bag is securely retained within the box. Preferably folding lines assist in compressing the box.

Figure 1:
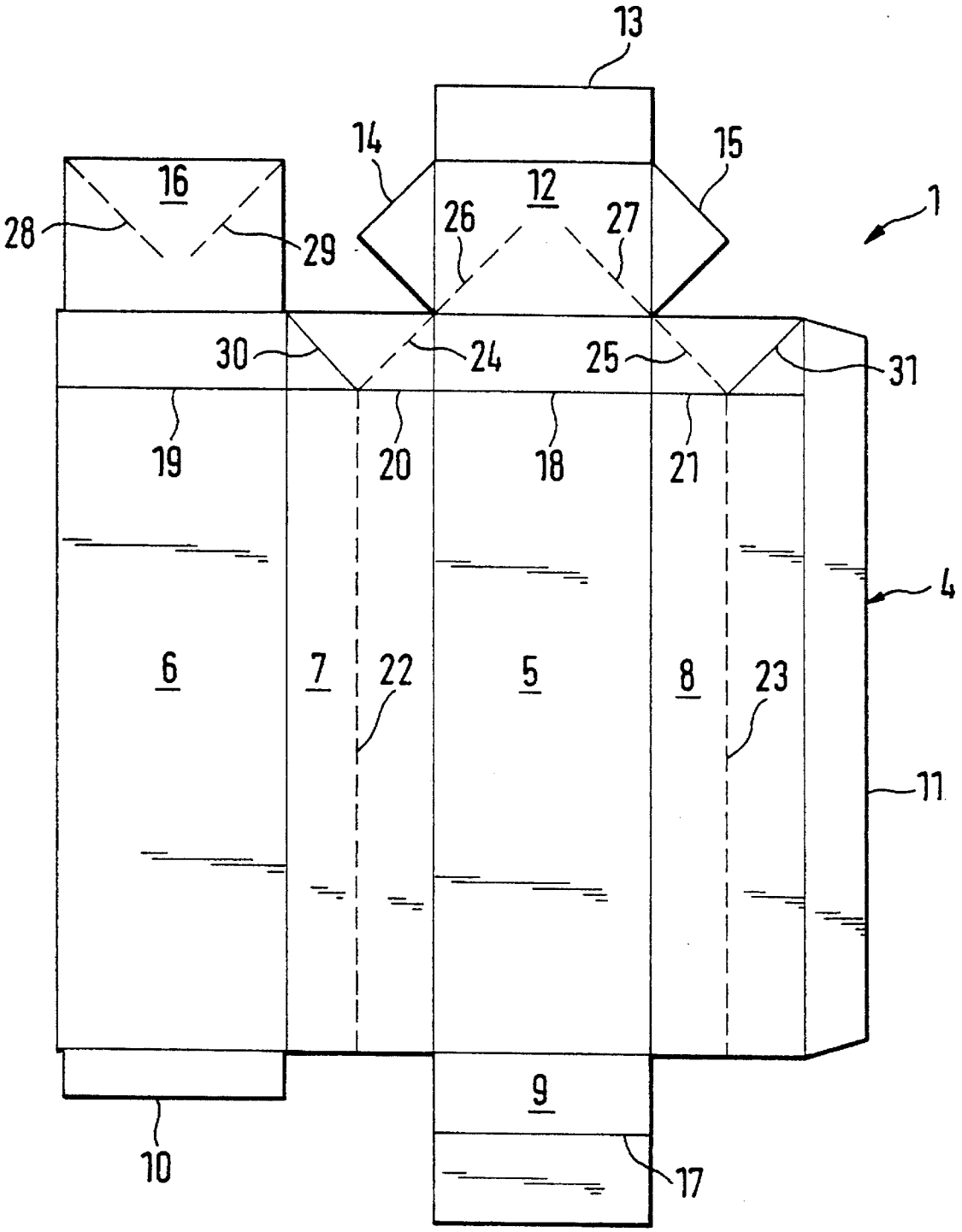
Figure 2:
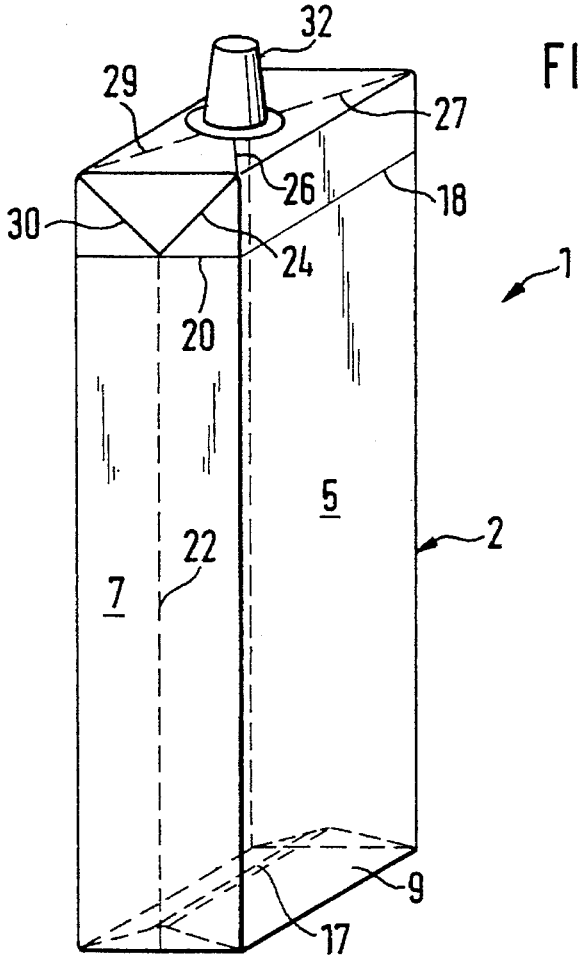
Figure 3:
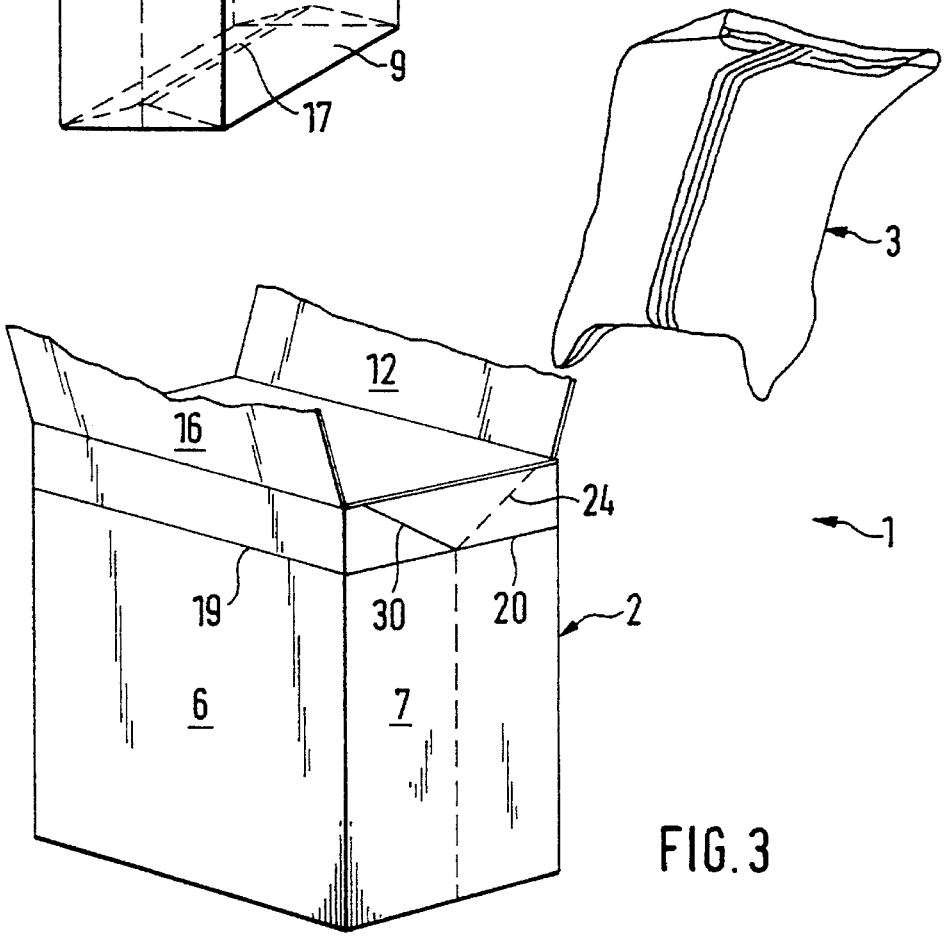

Further features and advantages of the invention will stand out from a description of embodiments in connection with the figures. In the figures FIG. 1 shows a blank for the carton of one embodiment of the tube box;

FIG. 2 shows the finished tube box according to the embodiment shown in FIG. 1 and FIG. 3 shows the opened tube box when removing the inner bag.

As may be best seen from FIG. 3 the tube box comprises an outer cardboard box 2 and an inner bag 3.

The cardboard box 2 is formed on the basis of the blank 4 shown in FIG. 1. The blank 4 comprises a first sidewall 5 and a second sidewall 6. A third sidewall 7 is provided between the first sidewall 5 and the second sidewall 16. A fourth sidewall 8 is provided at the first sidewall 5 opposite to the third sidewall 7.

A back wall 9 is provided at the rear side of the first sidewall 5 (the bottom side in FIG. 1). The back wall 9 extends substantially along the entire width of the first sidewall 5. The height of the back wall 9, i.e. the distance the back wall 9 extends away from the first sidewall 5, is slightly larger than the width of the third sidewall 7 or of the fourth sidewall 8, resp.

A paster tab 10 is provided at the bottom side of the second sidewall 6. A paster tab 11 is provided at the fourth sidewall 8 opposite to the first sidewall 5.

A first cover plate 12 is provided at the front side of the first sidewall 5 (the upper side in FIG. 1). The cover plate 12 extends substantially along the entire width of the first sidewall 5. The height of the first cover plate 12 corresponds substantially to the width of the third sidewall 7 or of the fourth sidewall 8, resp. A paster tab 13 is provided at the cover plate 12 opposite to the first sidewall 5. A respective triangular paster Lab 14 and 15 is provided at each side of the cover plate 12.

The front side of the second sidewall 6 has a second cover plate 16 provided thereat. The second cover plate 16 extends substantially along the entire width of the second sidewall 6. The height of the second cover plate 16 corresponds substantially to the width of the third sidewall 7 or of the fourth sidewall 8, resp.

The back wall 9 comprises a folding line 17. The folding line 17 extends substantially parallel to the bottom side of the first sidewall 5 in a distance from the bottom side of the second sidewall 5 which is about half of the height of the back wall 9.

The first to fourth sidewalls 5–8 comprise folding lines 18, 19, 20, 21. The folding lines 18–21 are formed substantially parallel to the front sides of their respective sidewalls. The distance from the front sides is about half the width of the third sidewall 7 or fourth sidewall 8, resp.

A weakening line 22 is formed in the third sidewall 7. The weakening line extends from the rear side to the folding line 20. The weakening line 22 runs substantially parallel to the lateral edges and substantially equidistant from the right and left lateral edge.

A corresponding weakening line 23 is formed in the fourth sidewall 8. The weakening line 23 also extends substantially from the rear side to the folding line 21. It is substantially parallel to the lateral edges and equidistant from both lateral edges.

A further weakening line 24 is formed in the third sidewall 7. The weakening line 24 extends from a location where the weakening line 22 meets the folding line 20 to the front connection point between the first sidewall 5 and the third sidewall 7.

A corresponding weakening line 25 is formed in the forth sidewall 8. It extends from a location where the weakening line 23 meets the folding line 21 to the front connection point between the first sidewall 5 and the fourth sidewall 8. The weakening lines 24 and 25 continue in straight direction into the first cover plate 12 as weakening lines 26 and 27, resp. They extend substantially to the center of the cover plate 12.

Weakening lines 28 and 29 are also formed in the second cover plate 16. The weakening lines 28 and 29 are a mirror image of the weakening lines 26 and 27, i.e. they extend from the upper corners of the cover plate 16 to substantially the center of the cover plate 16.

The third sidewall 7 comprises a folding line 30. The folding line 30 extends from the location where the weakening line 22 meets the folding line 20 to the front connection point between the third sidewall 7 and the second sidewall 6. It is therefore symmetric to the weakening line 24.

The fourth sidewall 8 comprises a folding line 31. The folding line 31 extends from the location where the weakening line 23 meets the folding line 21 to the front connection point between the fourth sidewall 8 and the paster tab 11. The folding line 31 is therefore symmetric to the weakening line 25.

The tube box is produced in the following manner:

A blank as shown in FIG. 1 is folded along the connection lines between the sidewalls and the paster tab 11 to form a sleeve and closed by gluing the paster tab 11 to the free lateral edge of the second sidewall 6. A film bag is drawn over a mandrel. The box sleeve is drawn thereover. Thereupon the second cover plate 16 is first folded over by about 90 degrees and thereafter the first cover plate 12 is folded over by substantially 90 degrees and glued to the second plate 16. Then the paster tab 13, the paster tab 14 and the paster tab 15 are folded over by substantially 90 degrees in this order and glued to the second sidewall 6, the third sidewall 7 and the fourth sidewall 8, resp.

A punching tool is put through the mandrel and a hole is punched through the film bag and the cover plates 12 and 16 by means of this punching tool. A pouring spout 32 as shown in FIG. 2 is inserted into this hole from outside, bent over therewithin by means of a forming die and rigidly connected with the bag and the folding box. The tube box prepared in this manner is drawn from the mandrel and forwarded to be filled through the open bottom.

The closing of the bottom starts by spreading and sealing the protruding film of the inner bag. The thus produced tags are folded inwardly by about 180 degrees. The back wall 9 is folded inwardly and glued to the paster tab 10 such that the back wall 9 bulges inwardly by about 10 degrees along the folding line 17. This is suitably obtained by the fact that the height of the back wall 9 is slightly larger than the width of the sidewalls 7 and 8, resp.

The tube box is used in the following manner:

After marketing of the filled tube box the consumer removes a seal provided on the pouring spout and compresses the two sidewalls 5 and 6 of the tube box from their rear end on. Thereupon the back wall bulges into the box. Thus the inner bag always securely remains within the box. By compressing the first and second wall 5 and 6 the third and fourth sidewall 7 and 8 are folded outwardly along the weakening lines 22 and 23. The transition to the front wall which is formed by the first and second cover plates 12 and 13 occurs along the weakening lines 24 and 25 and along the folding lines 30 and 31, resp. In this manner the tube box can be entirely compressed until the two sidewalls 5 and 6 are next to each other in parallel relationship and separated only by the emptied inner bag.

After completely emptying the tube box the consumer rips the box open. In FIG. 3 an intermediate ripping stage is shown wherein the two cover plates 12 and 16 are openen. Further, the box can be separated along the weakening lines 22, 23; 24, 25; 26, 27; 28, 29 and the inner bag may easily be removed. Thereafter the box consisting of an easily recyclable material and a light inner bag are available and both parts can be easily disposed of.

In the above embodiment the back wall 9 as well as the cover plates 12 and 16 have a rectangular shape. However, these part s may also be formed to have a triangular shape. In this case two of the three sidewalls are connected to the back wall, whereas the third sidewall is not connected with the back wall. When compressing the two sidewalls which are connected to the back wall the third sidewall is folded outwardly.

Moreover, a hexagonal form of the back wall and of the two cover plates can easily be realised. Again, two opposite sidewalls are connected with the back wall. The other four sidewalls are not connected with the back wall. When compressing the two sidewalls which are connected to the back wall the other four sidewalls automatically bulge outwardly. The weakening lines 22 and 23 of the initially described embodiment are not even required.

I claim:

1. A tube box comprising a prismatic cardboard box and an inner bag within said cardboard box, said cardboard box having a front wall, sidewalls connected to said front wall, and a back wall, a drain opening being provided within said front wall, said inner bag having an opening communicating with said drain opening, said back wall being connected only to two opposite side walls.

2. The tube box according to claim 1, wherein said back wall (9) comprises a folding line (17) extending parallel to said opposite sidewalls at a distance from said opposite sidewalls.

3. The tube box according to claim 1, wherein said front wall and said back wall have a rectangular shape.

4. The tube box according to claim 1, wherein said drain opening comprises a pouring spout passing through said front wall, thus connecting the interior of said inner bag to the outside of said tube box.

5. A rectangular box having first and second opposite rectangular sidewalls (5, 6), and third and fourth opposite rectangular side walls (7, 8), each said side walls having a length and width, said first sidewall connected to said third and fourth opposite side walls along a fold line, and said second sidewall connected to said third and fourth side walls along a fold line, said first and second side walls not directly connected to each other, said first and second sidewalls greater in width than said third and fourth side walls, a back wall (9, 10) only connected to said first and second side walls (5, 6) and having a fold line (17), said fold line positioned in said back wall between said first and second side walls, a front wall (12, 16) having an opening with a spout (32) therein, said front wall only coupled along a fold line to said first and second side walls, a first weakening line (22) and a second weakening line (24) in said third sidewall and a first weakening line (23) and a second weakening line (25) in said fourth side wall.

6. The box of claim 5 in which a bag is positioned in said box for coupling to said spout.

7. The box according to claim 5 in which the third side wall has a fold line (30) and the fourth side wall has a fold line (31).

8. The box according to claim 7 in which a fold line (20) is provided in the third sidewall and the weakening lines (22, 24) and the fold line (30) interconnect with one another at a fold line (20) provided in the third sidewall and the weakening lines (23, 25) and the fold line (31) interconnect with one another at a fold line (21) provided in the fourth sidewall (8).

9. The box of claim 8 in which a bag is positioned in said box of coupling to said spout.

* * * * *